US006740787B2

(12) United States Patent
Pinault et al.

(10) Patent No.: US 6,740,787 B2
(45) Date of Patent: May 25, 2004

(54) PROCESS FOR TREATMENT OF C4 HYDROCARBONS THAT COMPRISE BUTADIENE AND ACETYLENE COMPOUNDS THAT COMPRISE STAGES FOR DISTILLATION AND SELECTIVE HYDROGENATION

(75) Inventors: Mathieu Pinault, Lyons (FR); Vincent Coupard, Vaulx en Velin (FR); Christophe Boyer, Charly (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 131 days.

(21) Appl. No.: 10/024,500

(22) Filed: Dec. 21, 2001

(65) Prior Publication Data

US 2002/0128528 A1 Sep. 12, 2002

(30) Foreign Application Priority Data

Dec. 21, 2000 (FR) ..... 00 16726

(51) Int. Cl.[7] ..... C07C 5/03; C07C 5/08; C10G 45/32

(52) U.S. Cl. ..... 585/259; 585/261; 585/264; 585/265; 585/275; 585/271; 208/144; 208/145; 208/358

(58) Field of Search ..... 208/144, 145, 208/358; 585/259, 261, 264, 265, 275, 271, 277

(56) References Cited

U.S. PATENT DOCUMENTS 4,490,481 A * 12/1984 Boitiaux et al. ..... 502/330
6,072,091 A * 6/2000 Cosyns et al. ..... 585/259

FOREIGN PATENT DOCUMENTS

| | | |
|---|---|---|
| EP | 0273900 | 7/1988 |
| WO | 97/24413 | 7/1997 |

* cited by examiner

*Primary Examiner*—Walter D. Griffin
*Assistant Examiner*—Tam M. Nguyen
(74) *Attorney, Agent, or Firm*—Millen, White, Zelano & Branigan, P.C.

(57) ABSTRACT

A process for treatment of a batch with four carbon atoms that contains diene compounds and a minor portion of acetylene compounds is described. A portion of the fluid that circulates in a distillation zone that is enriched with acetylene compounds is drawn off laterally, preferably in the drainage zone, and a selective hydrogenation stage is carried out in a hydrogenation zone that is outside the distillation zone. The hydrogenation effluent that is produced is recycled in the rectification zone. A C4 fraction that comprises butadiene and that is low in acetylene compounds is recovered at the top, and a C5 fraction that is enriched with oligomers is recovered at the bottom.

19 Claims, 1 Drawing Sheet

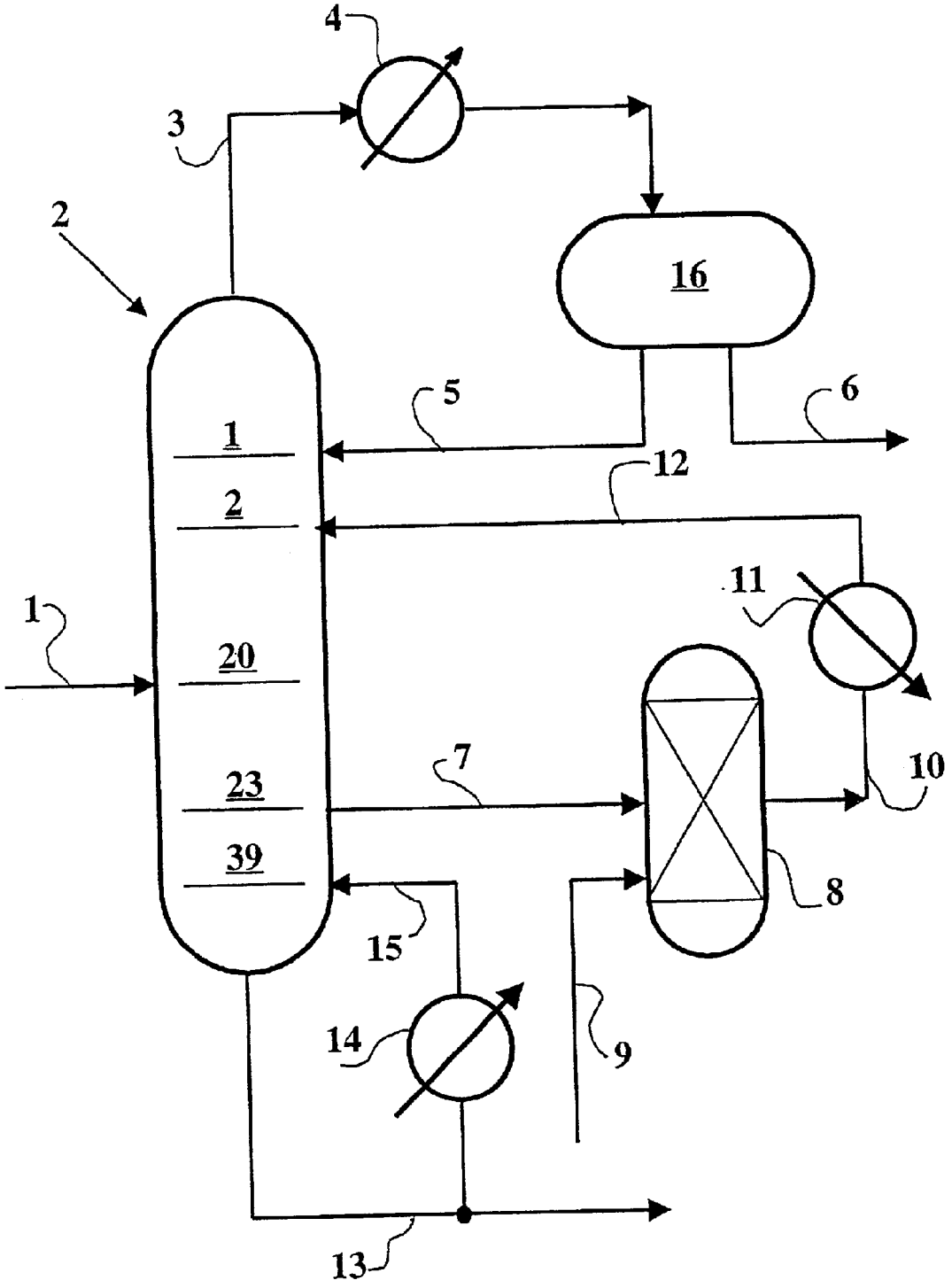
4
3
2
16
5
6
1
2
12
11
1
20
7
10
23
39
8
15
14
9
13

PROCESS FOR TREATMENT OF C4 HYDROCARBONS THAT COMPRISE BUTADIENE AND ACETYLENE COMPOUNDS THAT COMPRISE STAGES FOR DISTILLATION AND SELECTIVE HYDROGENATION

The invention relates to a process for treatment of a feedstock that comprises hydrocarbons with at least four carbon atoms per molecule, greatly unsaturated. It pertains in particular to the purification of an olefinic fraction that contains butadiene in large part, in particular butadiene 1,3, a highly upgradable product as a raw material of elastomers.

The prior art is illustrated by Patent Applications WO-97 24413 and EP-A-0 273 900.

This fraction also contains impurities of acetylenes, vinylacetylene (VAC), and ethylacetylene (ETAC), generally at a height of 1 to 2%, which create flaws in the polymerization processes due to the presence of gums that these compounds have a tendency to create and that should therefore be eliminated.

To eliminate the acetylene compounds, it is known to hydrogenate them in the presence of a catalyst that contains a noble metal of group VIII of the periodic table, alone or with promoters, deposited on a substrate such as alumina or silica.

Thus, in the main processes for hydrogenation of the acetylene compounds, oligomers (primarily dimers and trimers) form in the hydrogenation reactor that must then be separated from butadiene.

The hydrogenation reactor can be installed upstream from the debutanization column. Under these conditions, the ratio of acetylene compositions to butadienes is very small in the feedstock and the selective hydrogenation of these compounds is difficult to carry out, causing relatively high losses of butadiene.

According to another variant of the prior art, the feedstock that is to be treated can be introduced in a debutanizer. The C4 compounds and acetylene compounds are recovered at the top of the debutanizer, then hydrogenated in a reactor. The hydrogenation effluent is distilled again in another distillation column. The purified C4 fraction is recovered at the top of the distillation column while the oligomers that are obtained at the bottom of said column are recovered. Indeed, the acetylene compounds were concentrated in the debutanizer since the C5 were separated at the bottom, but the overall process requires an additional distillation column, which increases the investment and operating costs. In addition, the ratio of acetylenes to butadienes is unchanged relative to the preceding variant.

Furthermore, Patent U.S. Pat. No. 5,866,734 describes a process for hydrogenation of an olefinic C4 fraction that contains, for the most part, butadiene and acetylene compounds so as to hydrogenate essentially completely the compounds with multiple double bonds and triple bonds without loss of unsaturated hydrocarbons with a double bond, whereby the reaction can take place in a catalytic distillation column.

One of the objects of the invention is to eliminate the drawbacks of the prior art.

Another object is to hydrogenate selectively the acetylene compounds that are contained in a C4 fraction in the presence of hydrogen without thereby causing losses of butadiene that are too significant and at a cost that is the lowest possible. Another object is to purify a fraction that is very high in butadiene while minimizing to the maximum the losses of butadiene that are linked to the distillation and hydrogenation of said fraction.

Specifically, the invention relates to a process for treatment of a feedstock that comprises hydrocarbons with at least four carbon atoms per molecule, whereby said feedstock comprises diene compounds and primarily butadiene as well as acetylene compounds in a minor proportion, whereby said process comprises a distillation stage of the feedstock introduced in a distillation zone that comprises a rectification zone and a drainage zone and at least one hydrogenation stage of acetylene compounds in at least one hydrogenation zone with at least one catalytic bed under suitable hydrogenation conditions in the presence of a gas that contains hydrogen, whereby the process is characterized in that a portion of the feedstock that circulates in the distillation zone that is enriched with acetylene compounds is drawn off laterally in liquid phase at a suitable draw-off level in the distillation zone and preferably in the drainage zone; the hydrogenation stage is carried out in the hydrogenation zone that is outside the distillation zone; a hydrogenation effluent that is low in acetylene compounds and enriched in oligomers is produced; and said hydrogenation effluent is recycled in the rectification zone, whereby the process is also characterized in that a C4 fraction that comprises essentially all of the butadiene and that is low in acetylene compounds is recovered at the top of the distillation zone, and an oligomer-enriched C5 fraction is recovered at the bottom of the distillation zone.

The rectification zone (also known as an enriching zone) is defined as a zone that is located above the feed level of the feedstock of the distillation column.

The drainage zone (also known as a stripping zone) is defined as a zone that is located below the feed level of the feedstock of the distillation column.

The feedstock can be a steam-cracking effluent that for the most part contains hydrocarbons with four to five carbon atoms per molecule and preferably a majority of hydrocarbons with four carbon atoms.

This feedstock according to the invention can contain at least 20% by weight of butadienes and preferably at least 50% by weight in the C4 fraction alone. Furthermore, it generally contains at most 20% by weight of acetylene compounds, advantageously at most 5% and preferably at most 2.5% by weight.

According to a characteristic of the invention, the draw-off flow can be at most equal to twice that of the feedstock that is introduced in the column, advantageously at most equal to 1.5 times the one of the column. It is by drawing off from the drainage zone a liquid fluid flow that is approximately equal to the one of the feedstock that is introduced into the column that the best results are obtained.

According to a particularly advantageous characteristic of the process, the feedstock can be introduced at a level that corresponds approximately to the center of the distillation column, the lateral draw-off level is located below said center of the column at a height that generally corresponds to fewer than five theoretical plates from said center, and the hydrogenation effluent is recycled above the center of the column at a level that generally corresponds to a height within the first five theoretical plates from the top of the column.

By suitable chromatographic measurements, the ratio of concentrations of acetylene compounds to butadiene can be determined, and the fluid can be drawn off laterally when this ratio, on the plate of the column that is being considered, is essentially the highest and advantageously higher than the one of the feedstock.

At the level of the reinjection of the product of the hydrogenation reaction, it is advantageous to reinject this flow the highest possible in the column relative to the draw-off level so as to create an internal reflux in the column and therefore to increase its power of separation.

The increase in temperature linked to the hydrogenation is generally small because the amount of hydrogenated products is very small. Nevertheless, it may be advantageous to control the exothermicity of the hydrogenation stage and the temperature of the hydrogenation effluent upstream from the recycling level in the rectification zone of the column; it is especially preferable to reintroduce the fluid at the top of the column at a temperature that is approximately equal to that of the reintroduction plate so as not to disturb the distillation column.

The operating conditions of the distillation column are usually as follows:

Number of theoretical plates 40, preferably 35–45

Absolute pressure 4–10 bar (1 bar=$10^5$ Pa)

Top temperature: 45° C., preferably 30° C. to 50° C.

Bottom temperature: 95° C., preferably 90° C. to 150° C.

The hydrogenation reactor is generally operated under the following conditions:

Absolute pressure: 2 to 70 bar (1 bar=$10^5$ Pa), preferably 5 to 15 bar

Temperature: 30 to 60° C., preferably 35 to 45° C.

Volumetric flow rate 3 to 10 $31^1$, preferably 4 to 8 $h^{-1}$

The volumetric flow rate represents the catalyst volume divided by the liquid volume of fresh feedstock measured at 15° C.

Ratio of $H_2$/acetylene compounds (mol/mol): 0.5–3, preferably 1.0 to 1.1

Catalyst: either nickel or a collection mass that contains copper, or a noble metal of group VIII, preferably palladium, stabilized by at least one metal Au, Ag, for example 0.01 to 1% by weight of metal relative to the total weight of the catalyst;

said ratio of $H_2$/acetylene compounds will be adjusted based on the required specifications for the top effluent of the distillation column.

The invention will be better understood based on the following FIGURE, illustrating a preferred embodiment in a diagrammatic form.

A hydrocarbon feedstock 1 that comprises a C4 fraction that is obtained from a steam-cracking device and that contains about 50% of butadienes and 1 to 2% relative to the C4 fraction alone of acetylene compounds is introduced into a distillation column 2 called a debutanizer. This column comprising about 40 theoretical plates, the feedstock is introduced at the level of the 20th plate. At the top of the column, the C4 fraction that contains butadiene and about 1000 ppm of acetylene compounds is recovered via a line 3. A portion of this fraction is reintroduced after condensation 20 and separation 21 in the form of reflux 5 at the top of the column while the other portion is recovered via a line 6 for a subsequent treatment, an extraction by solvent for example.

At the level of the 23rd plate of the column, a liquid fluid whose ratio of acetylene compounds/butadiene concentrations is approximately the highest of the column is drawn off laterally via a line 7 by taking into account the dilution by a factor of 2 by the product of the reaction, for example equal to 0.027 mol/mol.

This fluid is introduced into at least one hydrogenation reactor 8 that is fed with hydrogen via a line 9 under partial pressure conditions that essentially correspond to the stoichiometry of the hydrogenation of acetylene compounds. This reactor contains a downflow fixed bed (introduction via the top of the reactor of the liquid feedstock) of hydrogenation catalyst that can be palladium that is stabilized by gold on a gamma alumina substrate. The hydrogenation effluent is collected via a line 10, cooled in an exchanger 11 and recycled in the 4th theoretical plate, for example of the rectification zone of the column, at a temperature that is approximately equal to that of this 4th plate.

This effluent contains in particular the olefinic compounds that are present initially in the feedstock, the butadienes that essentially have not been hydrogenated as well as the oligomers produced in the hydrogenation zone. These oligomer compounds, which are heavy products, are collected at the bottom of the column via a line 13 as well as hydrocarbons with 5 carbon atoms per molecule of the feedstock. A portion is used to be introduced into a reboiler 14 and recycled at the bottom of the column via a line 15.

The following examples illustrate the invention.

EXAMPLE 1

A C4 +C5 steam-cracking feedstock whose composition is described in Table 1 is introduced in the device that is described according to the figure, at its bubble temperature.

TABLE 1

| Phase | Charge Liquide | C4 Coupe de tete Liquide | C5 Coupe de fond Liquide |
|---|---|---|---|
| Pourcentages massiques | | | |
| PROPANE | 0.01 | 0.01 | 0.00 |
| PROPADIENE | 0.01 | 0.01 | 0.00 |
| PROPYNE | 0.02 | 0.02 | 0.00 |
| IBUTANE | 0.27 | 0.38 | 0.00 |
| ISOBUTENE | 13.66 | 19.22 | 0.00 |
| 1BUTENE | 9.06 | 14.40 | 0.01 |
| 13BUTADIENE | 32.52 | 44.51 | 0.04 |
| NBUTANE | 3.53 | 4.96 | 0.02 |
| TRANS2BUTENE | 4.26 | 6.66 | 0.06 |
| CIS2BUTENE | 2.00 | 3.11 | 0.10 |
| VAC | 0.73 | 0.03 | 0.05 |
| 1BUTYNE (ETAC) | 0.20 | 0.07 | 0.06 |
| 12BUTADIENE | 0.40 | 0.31 | 0.15 |
| ISOPENTANE | 1.67 | 0.44 | 4.68 |
| 2METHYL1BUTENE | 3.21 | 0.73 | 9.27 |
| ISOPRENE | 9.52 | 1.86 | 28.23 |
| PENTANE | 3.33 | 0.62 | 9.96 |
| TRANS2PENTENE | 1.43 | 0.26 | 4.29 |
| PENTADIENE | 3.33 | 0.44 | 10.39 |
| CYCLOPENTADIENE | 9.76 | 1.81 | 29.18 |
| CYCLOPENTENE | 0.48 | 0.07 | 1.49 |
| CYCLOPENTANE | 0.60 | 0.07 | 1.89 |
| 15ETHYLCYCLOHEXADIENE | — | 0.00 | 0.10 |
| 123TRIMETHYLINDENE | — | 0.00 | 0.02 |

[Key to Table 1:]
Charge = Feedstock
Coupe de tête = Top fraction
Coupe de fond = Bottom fraction
Liquide = Liquid
Pourcentages massiques = Percent by weight The feed level of the feedstock in the column, the lateral draw-off level and the recycling level of the hydrogenated effluent are usually selected so as to obtain 1000 ppm by weight of acetylenes in the C4 fraction while minimizing the loss of butadiene 1.3. This feedstock is introduced at the level of the 20th theoretical plate of the column.

The column has as its object to separate the C4 fraction from other hydrocarbons.

The operating conditions of the column have been set as close as possible to those of an industrial column. That is to say:

| | |
|---|---|
| Number of theoretical plates: | 40 (50 to 60 actual plates). |
| Working pressure: | 5 bar absolute at the top, 5.3 bar absolute at the bottom. |
| Working temperature: | 45° C. at the top, 95° C. at the bottom. |

The specifications of the column are as follows:

Liquid/distillate mass reflux rate=1.2

C4 content in the CS fraction: 0.5%

Feed at the bubble point (56° C.), pressure=6 bar absolute, flow rate=30 T/h.

At the level of the 23rd theoretical plate, a liquid effluent whose ratio of acetylene compounds/butadienes is equal to 0.27 mol/mol is drawn off laterally. The draw-off flow rate is equal to the flow rate of the feedstock.

This effluent is introduced into the catalytic hydrogenation reactor, which is operated under the following conditions in the
presence of hydrogen:

| | |
|---|---|
| Absolute pressure: | 5 bar |
| Temperature: | 40° C. at the inlet |
| Volumetric flow rate: | 4 $h^{-1}$ |
| Hydrogen flow rate: | 30 kg/h |
| Catalyst = palladium 2000 ppm | |
| LD 277(R) Procatalyse = Or 800 ppm | |

The hydrogenation effluent is recycled in the rectification zone of the column at the level of the 4th theoretical plate. The C5 hydrocarbons as well as the oligomers that are produced during the hydrogenation reaction will for the most part be recovered at the bottom of the column.

At the top of the column, C4 hydrocarbons are recovered whose composition is provided in Table 1 (top fraction), while at the bottom of the column, a C5 fraction that contains oligomers is recovered.

Conversion rate: The conversion rate of a product represents the amount of product (by mass) that disappeared.

Ex.: Conversion rate of VAC =0.95:

$1-(\text{Mass of VAC})_{output\ at\ the\ top\ of\ the\ column}/(\text{Mass of VAC})_{input}-0.95$.

It is the observed conversion rate.

Losses of butadiene: The losses of butadiene represent the amount of butadiene that is not recovered at the top of the column, i.e., the butadiene that is hydrogenated with butene at the level of the reactor plus the butadiene that is lost at the bottom of the debutanizer in the C5 fraction.

The losses of butadiene 1.3, the isomer with commercial advantage, are 2.7% while the content of acetylene compounds in the top fraction is 1000 ppm, which corresponds to a conversion rate of the vinylacetylene compound of 0.95.

EXAMPLE 2

For Comparison

Example 1 is used again under identical conditions, but instead of partially drawing off an effluent from the column, from the drainage zone to the rectification zone, it is drawn off from the rectification zone (10th plate), and the effluent is recycled in the rectification zone (7th plate). The draw-off flow rate is set at 20 T/h; the conversion rate of the VAC is 0.9.

In this configuration, the content of acetylene compounds in the C4 fraction that is collected at the top is about 3000 ppm, and the losses of butadiene are about 2%.

EXAMPLE 3

For Comparison

Example 1 is used again under identical conditions, but instead of partially drawing off an effluent from the column, from the drainage zone to the rectification zone, it is drawn off from the drainage zone (35th plate), and it is recycled after hydrogenation at the 32nd plate, in the drainage zone.

Whereby the butadiene content at the inlet of the hydrogenation reactor is very low (less than 1%), the losses are therefore negligible.

By contrast, the content of acetylene compounds at the top of the column is very high (greater than 8000 ppm). All of the acetylene compounds that return to the column at the feed level (20th plate) and that leave in the top zone are not hydrogenated by such a device.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 00/16.726, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Process for treatment of a feedstock that comprises hydrocarbons with at least four carbon atoms per molecule, whereby said feedstock comprises diene compounds and primarily butadiene as well as acetylene compounds in a minor proportion, whereby said process comprises a distillation stage of the feedstock introduced in a distillation zone that comprises a rectification zone and a drainage zone and at least one stage for hydrogenation of acetylene compounds in at least one hydrogenation zone with at least one catalytic bed under suitable hydrogenation conditions in the presence of a gas that contains hydrogen, wherein a portion of the feedstock that circulates in the distillation zone that is enriched with acetylene compounds is drawn off laterally in liquid phase at a draw-off level in the distillation zone and passed to a hydrogenation zone outside the distillation zone; a hydrogenation effluent that is low in acetylene compounds and enriched in oligomers is produced in said hydrogenation zone; and said hydrogenation effluent from said hydrogenation zone is recycled to a level in the rectification zone above the draw-off level, said draw-off level and recycle level being in communication with the same hydrogenation zone so as to create an internal reflux in the distillation column, whereby the process is characterized in that a C4 fraction that comprises essentially all of the butadiene and that is low in acetylene compounds is recovered at the top of the distillation zone, and an oligomer-enriched C5 fraction is recovered at the bottom of the distillation zone.

2. A process according to claim 1, wherein the feedstock is a steam-cracking effluent that contains for the most part hydrocarbons with four to five carbon atoms per molecule.

3. A process according to claim 1, wherein the butadiene content in the feedstock is at least equal to 20% by weight.

4. A process according to claim 1, wherein the feedstock contains at most 20% by weight of acetylene compounds.

5. A process according to claim 1, wherein the draw-off flow rate is at most equal to twice the flow rate of the feedstock introduced into the distillation zone.

6. A process according to claim 1, wherein the feedstock is introduced at a level that corresponds to substantially the center of the distillation column; the lateral draw-off level is located below said center of the column at a height that corresponds to fewer than five theoretical plates from said center; and the hydrogenation effluent is recycled above the center of the column at a level that corresponds to a height within the first five theoretical plates from the top of the column.

7. A process according to claim 1, conducting the process so that the ratio of the acetylene compounds/butadienes concentrations is the highest at the level of the lateral draw-off.

8. A process according to claim 1, wherein the operating conditions of the distillation zone are as follows:

Number of theoretical plates: 35–45

Absolute pressure: 4–10 bar,

Top temperature: 30° C. to 50° C.

Bottom temperature: 90° C. to 150° C.

9. A process according to claim 1, wherein the operating conditions in the hydrogenation zone are as follows:

Absolute pressure: 2 to 70 bar,

Temperature: 30 to 60° C.,

Volumetric flow rate 3 to 10 $h^{-1}$,

Ratio of $H_2$/acetylene compounds (mol/mol)=0.5 to 3,

Noble metal catalyst of group VIII, 0.01 to 1% by weight stabilized by at least one metal of the group formed by Au, Ag, Sn.

10. A process according to claim 1, further comprising adjusting the temperature of the hydrogenation effluent upstream from the recycling level in the rectification zone of the distillation column.

11. A process according to claim 1, wherein said portion of feedstock enriched with acetylenic compounds is drawn off laterally from the drainage zone.

12. A process according to claim 2, wherein the majority of hydrocarbons have 4 carbon atoms.

13. A process according to claim 3, wherein the butadiene content in the feedstock is at least 50% by weight.

14. A process according to claim 4, wherein the feedstock contains at most 2.5% by weight of acetylene compounds.

15. A process according to claim 5, wherein the flow rates are approximately equal.

16. A process according to claim 9, wherein the group VIII metal comprises palladium.

17. A process according to claim 1, wherein said draw-off level is in the drainage zone in said distillation zone.

18. A process according to claim 17, wherein the hydrogenation effluent from said hydrogenation zone is recycled to said rectification zone in said distillation zone.

19. A process according to claim 18, wherein the lateral draw-off level is located below the introduction of the feedstock to the distillation column and corresponds to fewer than 5 theoretical plates from said introduction of the feedstock, and the hydrogenation effluent is recycled above the introduction of the feedstock to the column at a level corresponding to a height within the first 5 theoretical plates from the top of the column.

* * * * *